US005223069A

United States Patent [19]

Tokuno et al.

[11] Patent Number: 5,223,069

[45] Date of Patent: Jun. 29, 1993

[54] WEB AUTO-SPLICER

[75] Inventors: Masateru Tokuno, Tokyo; Masaaki Ito, Yokohama, both of Japan

[73] Assignees: SK Engineering Ltd.; Reliance Electric Ltd., both of Kanagawa, Japan

[21] Appl. No.: 777,342

[22] PCT Filed: Apr. 12, 1991

[86] PCT No.: PCT/JP91/00479

§ 371 Date: Dec. 5, 1991

§ 102(e) Date: Dec. 5, 1991

[87] PCT Pub. No.: WO91/16255

PCT Pub. Date: Oct. 31, 1991

[30] Foreign Application Priority Data

Apr. 13, 1990 [JP] Japan ..... 2-96228

[51] Int. Cl.[5] ..... B65H 19/14; B65H 19/16

[52] U.S. Cl. ..... 156/351; 156/361; 156/504

[58] Field of Search ..... 156/157, 350, 351, 361, 156/502, 504

[56] References Cited

U.S. PATENT DOCUMENTS

| | | | |
|---|---|---|---|
| 3,948,715 | 4/1976 | Tokuno | 156/351 |
| 4,100,012 | 7/1978 | Meihofer et al. | 156/351 |
| 4,222,533 | 9/1980 | Pongracz | 156/502 X |
| 4,262,855 | 4/1981 | Haag | 156/504 X |
| 4,390,388 | 6/1983 | Nagata et al. | 156/351 |
| 4,526,638 | 7/1985 | Clements | 156/502 X |
| 4,543,152 | 9/1985 | Nozaka | 156/502 |
| 4,715,922 | 12/1987 | Hayashi et al. | 156/361 |
| 4,878,982 | 11/1989 | Ogata et al. | 156/505 X |
| 4,929,297 | 5/1990 | Sato | 156/361 |
| 5,045,134 | 9/1991 | Schenker et al. | 156/351 X |

FOREIGN PATENT DOCUMENTS

| | | | |
|---|---|---|---|
| 53-085266 | 7/1978 | Japan . | |
| 57-009928 | 2/1982 | Japan | 156/502 |
| 59-153753 | 9/1984 | Japan | 156/502 |
| 60-144267 | 7/1985 | Japan . | |
| 62-205954 | 9/1987 | Japan . | |
| 2-086537 | 3/1990 | Japan . | |

*Primary Examiner*—Robert Spitzer
*Attorney, Agent, or Firm*—McGlew & Tuttle

[57] ABSTRACT

With the splicing get started, braking becomes strong and the old core decelerates, when the capstan roll comes to be free run. The speed reference to the second motor is a summed-up speed of "line speed minus capstan speed" and compensated portion of the tension. At once when the old core starts deceleration, the accumulation roll unit starts moving. The capstan roll is accelerated at a certain rate, when the new core is drawn out, up until the speed reaches "line speed plus overrun speed". When the accumulation roll unit reaches the synchronous position, the overrun becomes "0" and the capstan roll synchronizes with the line speed.

4 Claims, 3 Drawing Sheets

WEB AUTO-SPLICER

TECHNICAL FIELD

The present invention relates to an automatic web splicing apparatus, particularly to a splicing apparatus in which high accuracy and high responsive tension control has become possible, enabling web splicing and ordinary running as well.

BACKGROUND ART

Prior automatic splicing apparatus, as shown in FIG. 1, detects the tension of the splicing apparatus' out-side by a detector 41, and controls a brake 3*b* of the first unwinder core 3*a* and a brake 4*b* of the second unwinder core 4*a* through a tension amplifier 42 so that the web tension at the time of ordinary running can be kept constant.

When splicing, the tension control is cut once; the unwinder core (old core) 3*a* is stopped by heavy braking at the same time; and the air pressure of an air accumulation roll unit 45 is fixed to the stroke-end by an air cylinder 46. When the speed of the unwinder core 3*a* decreases, the accumulation roll unit 45, pulled by the tension of a web (material) 7 via rollers such as roller 40, starts moving toward a direction where a cylinder stroke is shortened. Thus, while the unwinder core 3*a* make a speed-decrease/stop, and web splicing is over, the web accumulated in the accumulation unit is supplied.

The air pressure of the air cylinder 46 is gradually increased, as the web splicing work is over. At this time, the brake 4*b* of the unwinder core (new core) 4*a* is weaker; the accumulation roll unit 45 decreases its speed as the air pressure in the cylinder increases, and moves to the contrary direction (the direction in which the cylinder stroke is prolonged) finally to the stroke end.

The unwinder core 4*a*, due to the deceleration of the accumulation roll unit 45, starts feeding the web by a length equivalent to a difference between the volume of the line's pull-out and the volume of the accumulation sections's feed-out. At this time, to support acceleration of the unwinder core 4*a*, a motor 49 of a capstan roll 48 is driven. The motor 49 is stopped when the acceleration of the unwinder core 4*a* ends. The tension control of the unwinder core 4*a* resumes and the normal running starts.

In the conventional automatic web splicing apparatus, it has been impossible to hope for high accuracy and, high responsive tension, because the web tension of the out-side of the web splicing apparatus is controlled by the brake force of the unwinder core which has large inertia and because the web span up to a tension detector 41 is very large, and mechanical loss caused by intermediate roll's friction and the effect of acceleration and deceleration of the line speed piled up over the tension.

In the conventional automatic splicing apparatus, the web tension is not controlled while the tension control is stopped, and therefore, the various such problems as mentioned below cannot be avoided.

While decelerating the speed of the unwinder core (old core), the web tension is kept by the "push pressure" of the accumulation roll unit 45 which is brought by the air cylinder 46. It is impossible to change the air pressure of the air cylinder 46 in a moment from the state of normal running to the state as set for web splicing.

In addition, the inertia of the air cylinder together with the inertia of the accumulation roll unit 45 causes disturbance to a large extent against the web tension. The quicker the speed of the latter part process after splicing becomes, the more serious a problem it will be.

And, while accelerating, the acceleration torque to accelerate the unwinder core becomes a fluctuation of the tension. The motor 49 is driven during acceleration to supplement a certain volume of torque. But, as there exist webs of various diameter and/or width around the new core, the supplement is nothing but a supplement. Furthermore, the new core's acceleration time is determined by the accumulated tension and the unwinder core inertia, and therefore, it is required to rise the tension of the accumulation unit for rising the new core acceleration in a short period of time. But, this rise-time will become unstable.

Due to causes mentioned above, it has been impossible for the conventional web splicing apparatus to keep away from the occurrence of a large fluctuation of tension while performing web splicing at a high speed, and this tension fluctuation has caused outbreak of web snaps and/or creases on the web in the latter course of process after splicing. Therefore, it has been impossible to rise the process speed of the whole line.

DISCLOSURE OF THE INVENTION

It is an object of this invention to provide an automatic web splicing apparatus which will solve such problem as mentioned before.

With the above object to splice the web of one unwinder core with the web of the other unwinder core, the auto splicing apparatus of this invention comprises of;

a capstan roll unit composed of a driven roller to draw out the web from the above-mentioned unwinder core and a free run nip roller to hold the web, a first motor to drive this capstan roll unit, an accumulation roll unit composed of plural lines of web accumulated by plural number of driven rollers and free run rollers, an accumulation device which drives the accumulation roll unit linearly to and from by a belt, a second motor which drives the accumulation device, a web splicing device which splices the web of the one unwinder core with the web of the other unwinder core, a first speed control regulator to control the above mentioned the first motor, and a second speed control regulator to control the second motor.

In the present web automatic splicing apparatus of such a structure, when the splicing starts, the braking becomes strong, the old core starts deceleration, and the driven roll comes to be free-run. The second motor rotates with a speed reference "line speed minus capstan speed plus compensated tension". Simultaneously with the start of old core deceleration, the accumulation roll unit starts moving.

When the new core starts, the driven roll is accelerated with a certain rate up to a speed of "line speed plus overrun speed" until the accumulation roll unit comes to the synchronous position where the capstan speed synchronizes with the line speed.

BEST MODE FOR CARRYING OUT THE INVENTION

Figure 1:
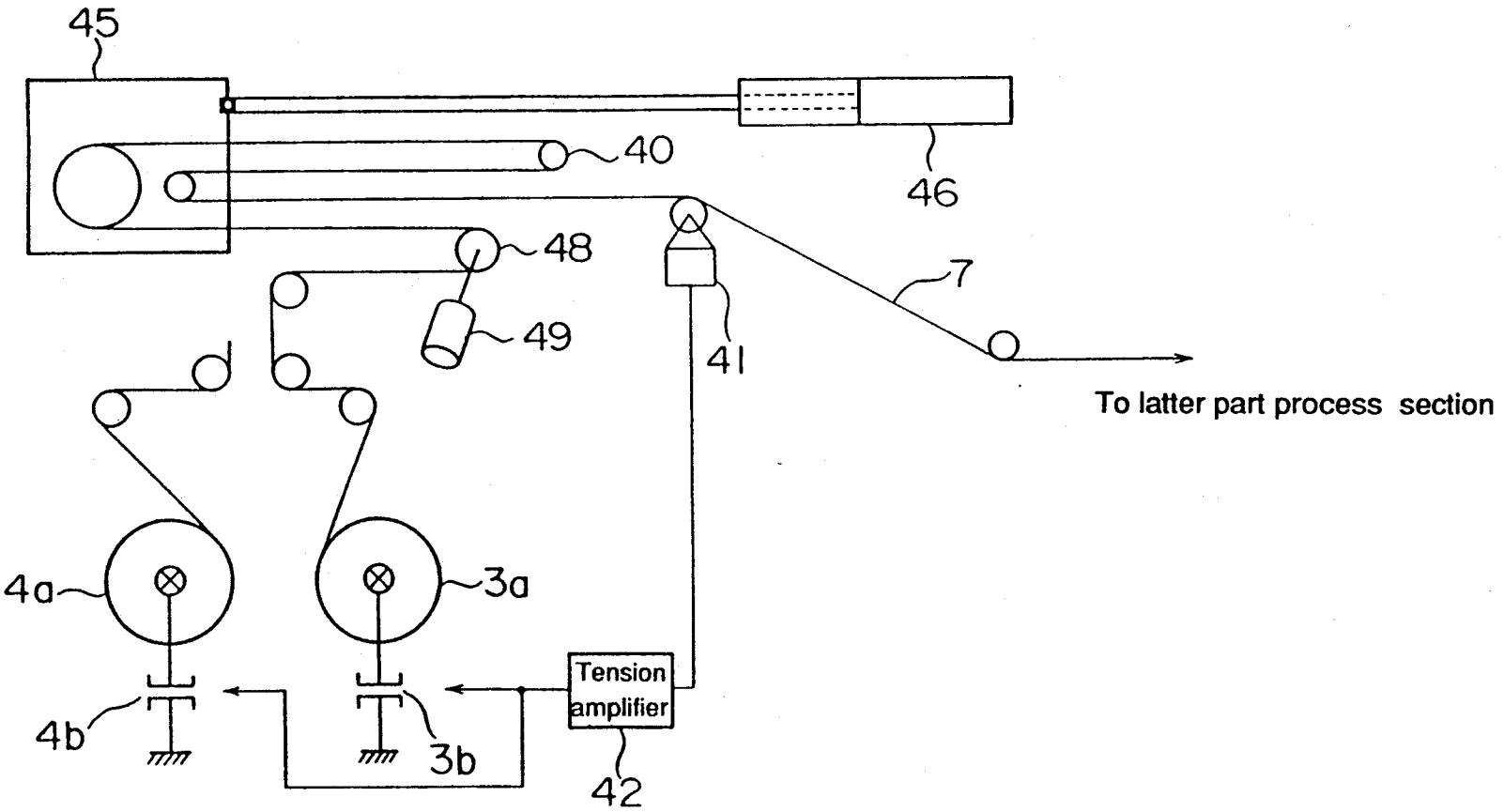
FIG. 1 is a block diagram showing the structure of a conventional web automatic splicing apparatus.
Figure 2:
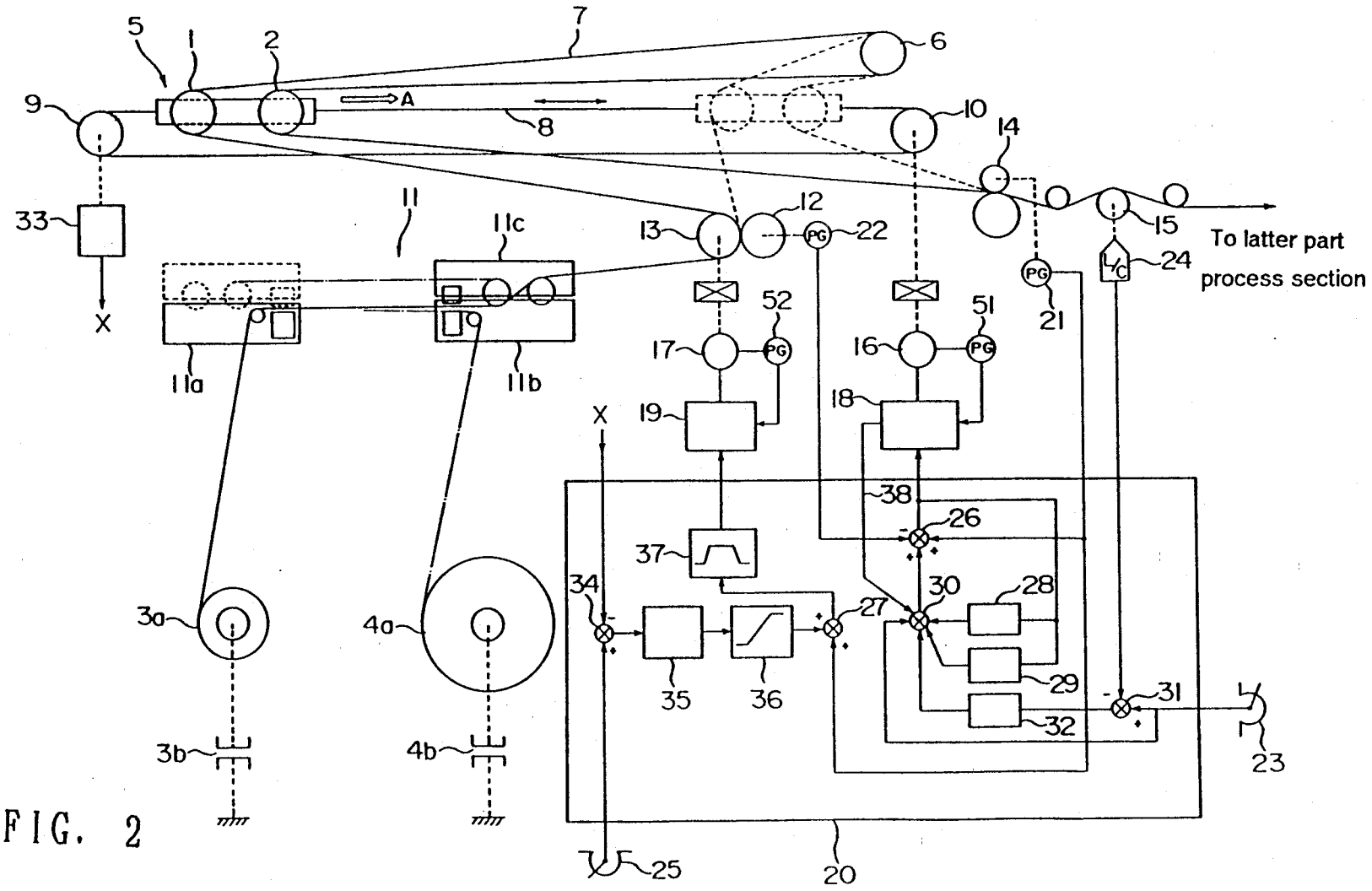
FIG. 2 is a block diagram showing an embodiment of the present invention.

FIG. 2 shows the structure of an embodiment of the present invention.

This automatic web splicing apparatus is provided with an accumulation roll unit 5 comprised of two accumulation rolls 1, 2, and a free run support roll 6, with which four accumulated web lines are composed. The accumulation roll unit 5 is driven both ways linearly by an accumulation device composed of two driven rollers 9, 10, and a timing belt 8 spread between two rollers.

A web 7 is fed from unwinder rolls 3*a*, 4*a* to an accumulation system composed of the accumulation roll unit and an accumulation device, via a web splicing unit 11 and a capstan roll unit composed of a driven roller 13 and a nip roller 12. From the accumulation unit, the web 7 is fed to the latter processing section through a line speed detection roll 14 and a web tension detection roll 15.

The web splicing unit 11 contains a fixed web holding station 11*a* for the web from the unwinder core 3*a*, a fixed web holding station 11*b* for the web from the unwinder core 4*a*, and a movable splicing station 11*c*.

The driven roller 10 of the accumulation device is driven by an AC servo motor 16, while the driven roller 13 of the capstan roller unit is driven by the AC servo motor 17. The rotation speed of these motors is controlled by speed control regulators 18 and 19. The speed reference to these speed control regulators is given by a speed reference input panel 20.

This speed reference input panel includes a circuitry to produce speed reference to the speed control regulator 18 and to the speed control regulator 19. The speed reference to the speed control regulator 18 is a summed-up speed of "line speed minus capstan speed (out of the driven roller 13)" and tension compensation. The speed reference to the speed control regulator 19 is a speed of "line speed plus overrun speed" given at the time of the new core rise.

To the speed reference input panel 20, the accumulation web tension between the capstan driven roller 13 and a tension detector (L/C) 24 is set in advance by means of a potentiometer 23, and the synchronous position (home position) of the accumulation roll unit 5 is set analogically by a potentiometer 25.

A circuit for tension compensation contains an adder 30, a mechanical loss compensation circuit 28, an accel/decel compensation circuit 29, a subtracter 31, a tension operation circuit 32, and a current minor loop 38.

The mechanical loss compensation circuit 28 compensates mechanical loss caused by intermediate roll friction by "ope-summing" the coefficient which is determined by speed reference to the speed control regulator 18. The accel/decel compensation circuit 29 compensates the loss involved in accel/decel in the accumulation unit by differentiating the speed reference to the speed control regulator 18 and ope-summing the coefficient. These compensations will be made with accel/decel torque of the accumulation until and the intermediate rolls' mechanical loss counted or measured in advance.

The subtracter 31 obtains a tension error by subtracting the web tension of the output side of the splicing unit detected by the tension detector 24 on the roll 15 from the set tension.

The tension operation circuit 32 integrates a tension error from the subtracter 31 proportionally. It takes a considerable time to rise the tension operation circuit 32. And therefore it is devised to get the current of the motor 16 sent back from the sped control regulator 18 to the adder 30 as a torque signal, and with this feedbacked loop, tension is maintained until the tension operation circuit 32 completely rises.

Tension compensation portion is obtained by ope-summing, at the adder 30, tension reference from the mechanical loss circuit 28, tension reference from the accel/decel compensation circuit 29, tension reference from the potentiometer 23, tension error from the operation circuit 32 and feedback from the current minor loop 38.

Figure 3:
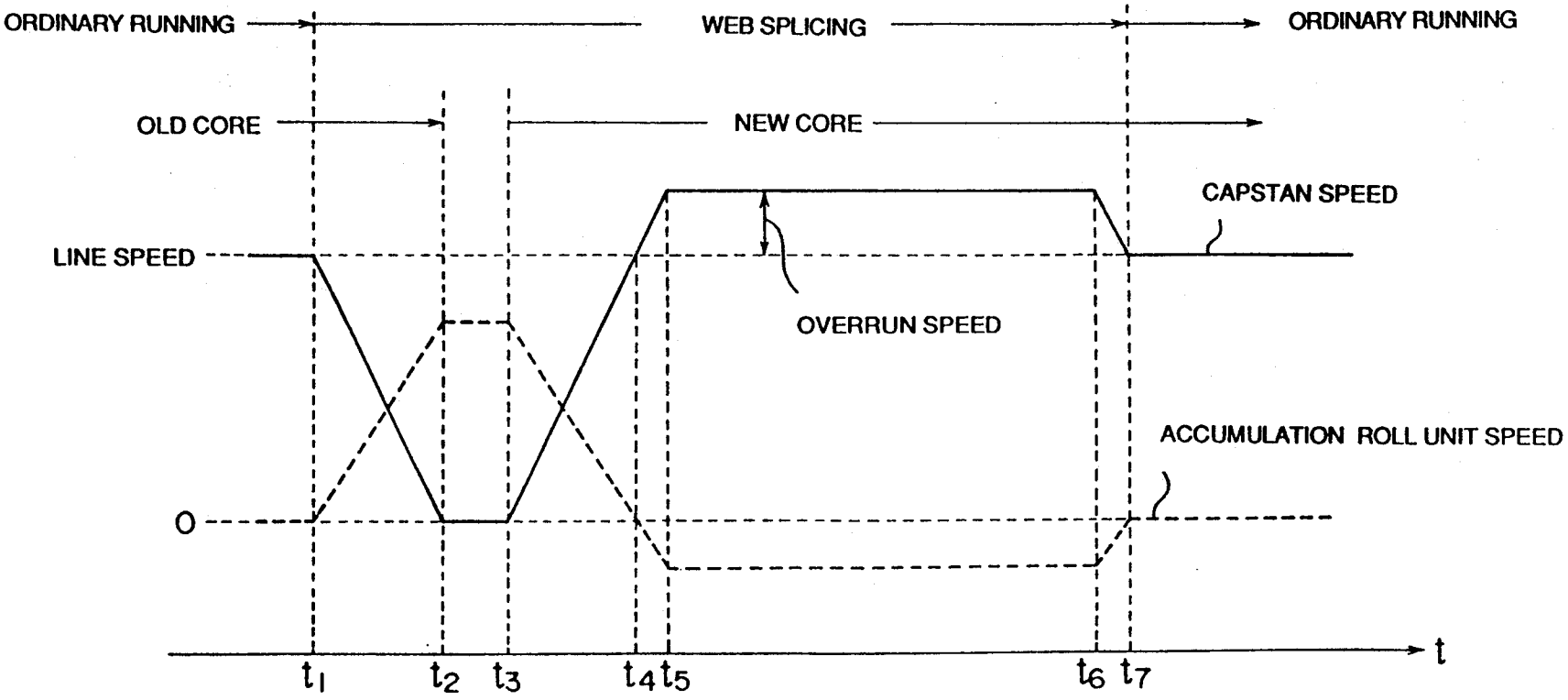
FIG. 3 is a speed chart for explaining the operation of the embodiment in FIG. 2.

Referring now to FIG. 3, the operation of the embodiment shown in FIG. 2 is explained. FIG. 3 is a chart showing the capstan speed after splicing and the accumulation roll unit speed.

In an ordinary running, the accumulation roll unit 5 is stationary at the synchronous position (home position). The web 7 is fed from the unwinder core 3*a* to the latter processing section through the web splicing unit 11, the capstan driven roll 13, the accumulation roll 1, the free run support roll 6, the accumulation roll 2, and the roll 15.

Speed reference to the speed control regulator 18 is the output of the accel/decel operation circuit 26: line speed from a pulse generator (PG) 21 of the roll 14 minus the capstan speed from a pulse generator (PG) 22 of the nip roll 12 plus tension compensation from the adder 30. In an ordinary running, line speed is equal to the capstan speed, and therefore, only tension compensation from the adder 30 will become the speed reference for the speed control regulator.

Consider that the web splicing starts at "$t_1$" in FIG. 3. (In FIG. 2,) at the time of web splicing, the unwinder core 3*a* (old core) is forced to stop by a strong brake. The roll 13 is made free run at the same time so that the web speed synchronizes with the unwinder core 3*a*. Therefore, as seen in FIG. 3, the capstan roll 13 speed is decelerating as the braking of the unwinder core 3*a* increases. The accumulation unit, with a speed reference of "line speed minus capstan speed plus tension compensation", starts feeding the accumulation roll unit 5 toward arrow A.

The output of the adder 30 is given to the accel/decel operation circuit 26 as tension compensation, and a speed reference of "line speed minus capstan speed plus tension compensation" is given to the speed control regulator 18. By this speed reference, the accumulation roll unit 5 is increasing its feeding speed as shown in FIG. 3.

At the time of "$t_2$", when the old core 3*a* and the capstan roll 13 stop, web splicing starts. Web splicing of the old core 3*a* with the new core 4*a* is held and is completed at "$t_3$". During $t_2$ and $t_3$, the capstan roll 13 is suspended, the accumulation roll unit 5 feeds at a certain speed toward arrow a and the web 7 accumulated in the accumulation unit is supplied to the latter process section. In this example, the web is accumulated on four lines, and therefore, feed can be made at a speed of "¼ line speed".

When the web splicing competes at $t_3$, the capstan roll 13 will enter into a state of speed control . A synchro-generator 33 mounted on the driven roller 9 in the accumulation unit detects the position of the accumulation roll unit 5, and sends it (position of the accumulation roll unit 5) to the subtracter 34 in the speed reference input panel 20.

At the subtracter 34, the position detected is compared with the value set analogically by the potentiometer 25 to get a position error. The position error is proportionally integrated at a position operation circuit 35; and at a limit circuit 36, a portion of acceleration equivalent to overrun speed is set. This acceleration portion is set, for example 10% or 20% of line speed, depending on the apparatus structural scale. The output of the limit circuit 36 is added, at the subtracter 27, to line speed from PG 21, and is sent to a ramp function generator 37.

The capstan sped is accelerated to speed of "line speed plus overrun speed" as shown in FIG. 3, at a certain acceleration rate with a ramp function provided by the ramp function generator 37. This is to protect the web from the unwinder core 4*a* (new core) after splicing from being imposed by too much tension when the capstan roll 13 is accelerated rapidly. The output of the ramp function generator 37 is given as a speed reference to the speed control regulator 19, which accelerates a servo motor 17 rising the capstan speed to "line speed" at $t_4$, to a speed of "line sped plus overrun speed" at $t_5$. The capstan roll 13 is nipped by the nip roller 12 and therefore, accelerates the new core.

As the capstan speed from PG 22 of the roll 12 increases, the value of speed reference to the speed control regulator 18 become smaller as started before. As a result, the speed of the accumulation roll unit 5 decreases, as shown in FIG. 3, finally to stop at $t_4$. Between $t_4$ and $t_5$, the speed reference (line speed minus capstan speed) becomes negative, when the accumulation roll unit 5 starts moving toward the opposite direction, that is, the synchronous position.

After $t_6$, the capstan roll 13 rotates at a certain speed of "line speed plus overrun speed", while the accumulation roll unit 5 moves at a certain speed of "line speed minus overrun speed" toward the synchronous position.

When the accumulation roll unit 5 returns the synchronous position (home position) at $t_6$, the position error output from the subtracter 34 becomes "0" and overrun speed also becomes "0". At $t_7$, the accumulation roll unit stops at the home position, and the capstan speed synchronizes with the line speed to enter in an ordinary running.

The above is the explanation made in detail on one embodiment of this invention. But, the application of this invention is not limited to this embodiment. Various modifications and variations are available within the scope of this invention.

For example, for detecting the position of the accumulation roll unit, it is possible to use a potentiometer of detecting the shaft rotation of the drive shaft 9.

Also, it is possible to detect the position of the accumulation roll unit 5 directly from the output of PG 51 of the servo motor 16. For this purpose, set a pulse counter in the speed reference input panel 20, and supply the output of this pulse counter to the subtraction side of the subtracter 34. On this occasion, the synchronous position of the accumulation roll unit is digitally set.

In the explanation of this example, the capstan speed (at the driven roll 13) is detected by PG 22 mounted on the roll 12. But, it is also possible to detect the capstan speed using the output of PG 52 of the servo motor 17. On this occasion, PG 22 will become of no use.

In the explanation of this embodiment, explanation was on the case of four web lines in the accumulation unit. But, it is possible to use different number of lines, two or six for example. In the case of two lines, the feed speed of the accumulation roll unit during splicing is ½ of the line speed, and in the case of six lines, 1/6 of the line speed.

INDUSTRIAL APPLICABILITY

In this invention, the web tension in the accumulation unit is controlled. Compared with the conventional web splicing apparatus in which the large-inertia unwinder core is controlled, the splicer of this invention is highly responsive to tension fluctuation and highly accurate control is possible. It is also possible to do tension control continuously even web splicing.

It is also possible to suppress and disturbance caused by inertia of the accumulation section by moving the accumulation roll unit actively and momentary by a servo motor while the unwinder core is in deceleration.

The possible tension fluctuation due to the new core's acceleration to torque does not affect the tension on the output side of the web auto-splicing apparatus, because the web of the capstan roll is nipped and the new core is accelerated by the drive of the capstan roll thereby cutting the tension. This means that a high-class control is not required for the brake control of the unwinder core.

With the reasons mentioned above, it has become possible to do web splicing in a high speed rising the total process capabilities of the line.

We claim:

1. An automatic web splicing apparatus for splicing a web of one unwinder core with a web of another unwinder core, for feeding a web at a line speed to a downstream process section comprising:

a capstan roll unit composed of a driven roller to draw out the web from the unwinder cores and a free run nip roller to hold the web, a first motor for driving the capstan roll unit, an accumulation roll unit composed of a plurality of lines of web accumulated by a plurality of driven rollers and free run rollers, accumulation drive means for driving the accumulation roll unit linearly to and from by a belt for decreasing and increasing the accumulated web, a second motor for driving the accumulation drive means, a web splicing device for splicing web of one unwinder core with the web of the other unwinder core, first speed control regulator means for controlling the first motor, second speed control regulator means for controlling the second motor so that the tension of lines of accumulated web in the accumulation roll unit is controlled, first circuitry means for applying a first speed reference signal to said first speed control regulator for operating said first speed control regulator to attain a speed reference based on line speed plus an overrun speed and;

second circuitry means for applying a second speed reference signal to the second speed control regulator for operating said second speed control regulator at a speed reference based on line speed minus present capstan speed (the speed of the web as it is drawn out from the capstan roll unit) plus a tension compensation value based on measured web tension.

2. An automatic web splicing apparatus as set forth in claim 1 further comprising:

a line speed detection roll, and a first pulse generator coupled to the line speed detection roll for detecting the line speed, wherein the line speed from the first pulse generator is supplied to both of the first circuitry means and the second circuitry means.

3. An automatic web splicing apparatus as set forth in claim 2 further comprising a second pulse generator coupled to the free run nip roller for detecting the capstan speed, wherein the capstan speed from the second pulse generator is supplied to the first circuitry means.

4. An automatic web splicing apparatus as set forth in claim 1, wherein said tension compensation value is based on a tension error signal formed by subtracting web tension from a set tension value, said web tension being sensed by a tension detector connected to a roll engaging the web on an output side of the splicing unit.

* * * * *